United States Patent [19]

Hessing et al.

[11] Patent Number: 4,869,608

[45] Date of Patent: Sep. 26, 1989

[54] RESONANT FREQUENCY RECIPROCATING DRIVE MECHANISM

[75] Inventors: Lynn C. Hessing, Boise; John W. Huffman, Meridian; Ben B. Tyson, Eagle, all of Id.

[73] Assignee: Hewlett-Packard Company, Palo Alto, Calif.

[21] Appl. No.: 153,900

[22] Filed: Feb. 9, 1988

[51] Int. Cl.[4] ..... B41J 1/56

[52] U.S. Cl. ..... 400/320; 400/322; 267/160; 267/161

[58] Field of Search ..... 400/320, 322, 328; 267/160, 170, 174

[56] References Cited

U.S. PATENT DOCUMENTS

| | | | |
|---|---|---|---|
| 3,417,984 | 12/1968 | Sindlinger | 267/160 |
| 4,236,835 | 12/1980 | Mayne et al. | 101/93.04 |
| 4,359,289 | 11/1982 | Barrus et al. | 400/322 |
| 4,599,007 | 7/1986 | Khorsand | 400/121 |
| 4,637,307 | 1/1987 | Miller | 400/124 |

*Primary Examiner*—Paul T. Sewell
*Assistant Examiner*—Steven S. Kelley
*Attorney, Agent, or Firm*—Leslie G. Murray

[57] ABSTRACT

A resonant frequency reciprocating print bar drive mechanism having print bar assembly mass 12 and counterweight 13 held in spaced relationship to each other by first and second leaf springs 16 and 17, which are of equal flexural stiffness. Drive solenoid 14 is mounted between the first and second springs 16 and 17, for inducing reciprocal oscillation between print bar 12 and counterweight 13. The print bar assembly, counterweight and spring assembly is itself suspended as a single unit from perimeter frame 11 by suspension springs 15. Suspension springs 15 have a much lower spring rate than that of leaf springs 16 and 17, and, as a result, the print bar assembly 12 and counterweight 13 will reciprocally oscillate, relative to each other, at a single resonant frequency.

3 Claims, 6 Drawing Sheets

RESONANT FREQUENCY RECIPROCATING DRIVE MECHANISM

BACKGROUND OF THE INVENTION

This invention relates, in general, to reciprocating drive mechanisms for dot matrix printers, and more particularly, to a reciprocating drive mechanism for high speed dot matrix printers having a plurality of print wires or hammers assembled in a print bar assembly for horizontal line dot matrix printing.

There are a variety of methods and apparatus for imprinting alphanumeric characters or other information onto paper or other printing medium. Some of which would include daisy wheels, ink jets, electrophotographic and dot matrix printers. Dot matrix printers are generally available in two different design classifications, the first being serial printers, and the second, line printers. Serial printers usually have a cluster of selectively operable print wires which sequentially form independent and complete alphanumeric characters as the print wire cluster assembly is moved across the page from left to right and back. Dot matrix line printers utilize a temporary printer memory into which is transferred a complete line of information to be printed. The print bar assembly normally contains a plurality of selectively operable print wires or hammers arranged in a single horizontal row and is utilized to print a complete horizontal line of dots which, when all of the horizontal lines of the intended matrixes for that line of information are printed, will form a complete line of information.

Horizontal line, dot matrix, printers are the printers of choice for high speed printing applications. The print bar assemblies normally contain a large number, typically ranging from 33 to 132, of selectively operable print wires or hammers for printing each horizontal line of the desired dot matrix for each line of information to be imparted to the printing medium. The large number of print wires or hammers is necessary in order to minimize the horizontal travel of the print bar assembly, thus minimizing travel time across the page and increasing the speed at which the information is printed. Print bar assemblies for high speed dot matrix line printers, having a large number of print wires or hammers in the assembly, represent a substantial mass to be oscillated back and forth. Typical oscillation rates range from 15 Hz. to 80 Hz. At these oscillation rates the vibration induced in the printer by the oscillation of the print bar assembly is significant and represents a substantial design problem. As a result, high speed dot matrix line printer frames are usually rather stoutly constructed. A variety of mechanical designs have been developed to incorporate some sort of a reciprocating counter mass into the printer frame design so as to reduce the mechanical vibration caused by the oscillation of the print bar assembly.

Another problem with the current designs is that, unless the desired oscillation rate can be matched with a resonant frequency of a mechanically sprung print bar assembly, a significant amount of force is needed to drive the print bar assembly at the desired oscillation rate. This has resulted in substantial efforts to design print bar assembly suspension systems which will provide the desired resonant frequency, and, control systems for maintaining the oscillation rate of the print bar assembly at the desired frequency.

Pennebacker, U.S. Pat. No. 4,227,557, discloses a suspension arrangement for a high speed printer having two print bar assemblies, each mechanically sprung to an intermediate frame which, in turn, is mechanically sprung to the main printer frame. The electrical control systems of Pennebacker is designed to monitor and maintain each of the two print bar assemblies at the same resonant frequency in reciprocal oscillation to each other so as to minimize the force required to drive the printer and also to counter balance the vibrations induced by the oscillation of each of the individual print bar assemblies.

Matsumoto, et al., U.S. Pat. No. 4,421,430, discloses a printing mechanism which is provided with a counterbalanced hammer bank such that the hammer bank and a counterweight are oppositely reciprocated by a pair of coaxial identical, orthogonally oriented cams. This is a mechanical drive system which attempts to insure a reciprocal oscillation of the print bar assembly and counterweight, but is difficult and expensive to produce and is subject to wear in high speed dot matrix line printer applications.

Mayne, et al U.S. Pat. No. 4,463,300, discloses a linear motor digital servo control system in combination with a print bar assembly which is allowed to bump into shock absorbing mechanical springs attached to the print bar assembly at each end of the print bar assembly's line of travel.

One of the most common embodiments in use today utilizes a design wherein a print bar and a counterweight are each mechanically sprung, by the use of leaf springs, from the print bar assembly. A linear motor is mechanically connected between the two mass assemblies and is used to drive each, simultaneously, in reciprocal oscillation to the other. A typical embodiment of this design is shown in FIGS. 1 of both Khorsand, U.S. Pat. No. 4,599,007 and Miller, U.S. Pat. No. 4,637,307. This design is also shown, for purposes of comparison with our new design, in FIGS. 2 through 5 of this specification.

A major problem with the design disclosed by Khorsand and Miller is that substantial care must be taken to insure that the spring rate and the mass for the print bar assemblies are carefully matched to the spring rate and mass of the reciprocal counterweight to insure a single resonant frequency at the desired oscillation rate. The resonant frequency for a mass mechanically sprung to a fixed frame can be determined by the following mathematical formula:

$$F_{rn} = \frac{1}{2\pi}\sqrt{\frac{K}{M}}$$

Where $F_{rn}$ represents a resonant frequency, K equals the spring constant and M represents the mass being oscillated. Utilizing this formula, it becomes apparent that when two independently sprung masses are driven in reciprocal oscillation to each other it becomes necessary to match the masses and spring constants in order to develop a single resonant frequency. Mathematically represented, the matching formula is as follows:

$$\frac{1}{2\pi}\sqrt{\frac{K_1}{M_1}} = \frac{1}{2\pi}\sqrt{\frac{K_2}{M_2}}$$

Where $M_1$ represents the mass of the print bar assembly, $K_1$ the spring rate for the print bar assembly springs, and $M_2$ the mass of the counterweight, which may include the the driver assembly, and $K_2$ the spring constant for the counterweight springs. Matching these rates is a difficult, time consuming and often expensive process.

Another problem with the current design as disclosed in Khorsand and Miller is that this design results in substantial bending moments around the points of attachment of the springs to the printer frame. FIGS. 4 and 5 of this disclosure represent mechanical schematic representations of these bending moments for the designs disclosed in FIGS. 1 of Khorsand and Miller. FIGS. 4 and 5, as later described in this disclosure, are used for illustrative purposes and comparison with the design disclosed herein.

It is an object of this invention to provide an apparatus whereby the relevant mechanical spring connection between the reciprocally oscillating print bar assembly and counterweight is a mechanical spring assembly operatively connecting the two mass assemblies to each other as opposed to independently springing each to a fixed printer frame, thus eliminating the need to match masses and spring rates in order to obtain a single resonant frequency. A second object of this invention is to significantly reduce the bending moments imparted to the printer frame as a result of the reciprocal oscillation of independently sprung print bar assemblies and counterweights when in reciprocal oscillation.

A third object is to reduce the time and cost of manufacture of a high speed print bar assembly.

SUMMARY OF THE INVENTION

These objects are accomplished by use of a printing apparatus having a print bar assembly mass and a counterweight mass, held in spaced relationship one to the other by means of first and second leaf springs of equal spring flexure value, which are also held in parallel spaced relationship to one another. The first leaf spring is connected to the print bar assembly, and the second to the counterweight mass. A solenoid, having an outer winding assembly and a slideably mounted core is disposed between the first and second leaf springs, and, when energized, induces reciprocal oscillation to the print bar assembly and the counterweight masses through action on the springs.

A perimeter frame is provided, from which the entire printer bar assembly, leaf springs, and counterweight mass assemblies are suspended.

The mechanical design of the assembly permits only one resonant frequency for the oscillation induced by the drive solenoid, and as a result no control of the frequency of oscillation is needed. Means are also provided for controlling the amplitude of oscillation including a velocity transducer operatively connected to the print bar. Since the frequency of oscillation is constant at the resonant frequency, the velocity transducer will generate an electrical signal whose amplitude is proportional to the amplitude of oscillation of the print bar.

A rectifier, electrically connected to the output of the velocity transducer generates a full-wave rectified signal, the peak valve of which is proportional to the amplitude of oscillation of the print bar. An integrator circuit is provided for integrating the unrectified velocity transducer signal to generate an output signal proportional to the position of the print ar mass. A zero crossing comparator operatively connected to the output of the integrator circuit is used to close an electronic switch when the print bar mass is travelling at its maximum velocity which, by definition, is when the print bar passes through the midpoint of its oscillation, which is the zero point of the sinusoidal position voltage signal generated by the integrator circuit.

The electronic switch is used for sampling and storing the amplitude of the output from the rectifier when the print bar mass is traveling at its maximum velocity twice during each cycle of reciprocal oscillation. This is compared in a summing circuit to an analog reference signal generated by a microprocessor to generate an error signal proportional to the difference between the reference signal and the output of the electronic switch. This signal represents an error signal, and, after being amplified by a loop amplifier, is used to drive an output amplifier operatively connected to the drive solenoid.

A direction comparator is connected to the output of the integrator circuit and provides a reference signal indicative of the direction of travel of the reciprocally oscillating masses.

The polarity of the error signal generated by the summing circuit signals whether or not the amplitude of oscillation of the printer bar mass is greater or less than that desired. The output amplifier, upon receiving this signal, uses the signal from the direction comparator to determine when to supply energy to the drive solenoid. If the amplitude is less than that desired, energy will be applied when the print bar and the drive solenoid are moving toward each other to increase the amplitude. Conversely, if the amplitude is greater than that desired, energy will be applied to the drive solenoid windings during the reverse portion of the oscillation cycle.

DETAILED DESCRIPTION OF THE PREFERRED EMBODIMENT

Figure 1:
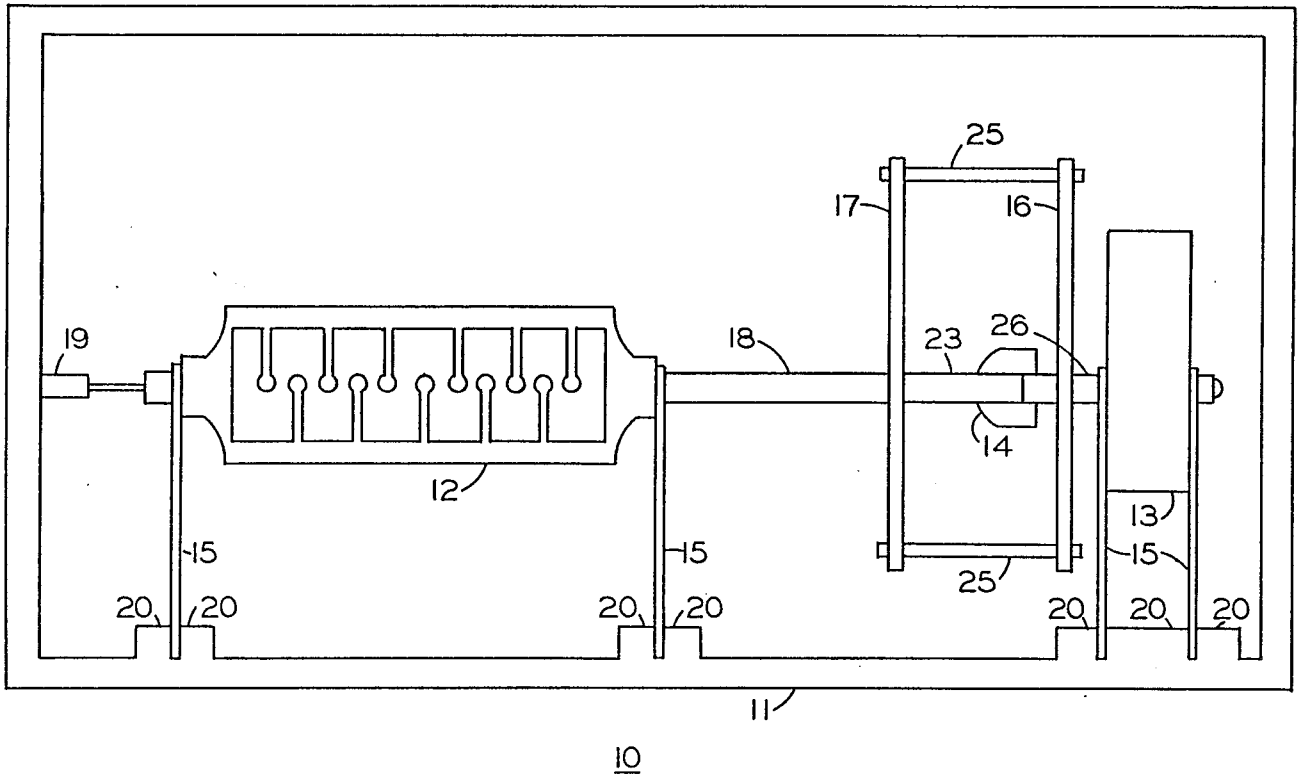
FIG. 1 is a representational plan view of a counterweight and print bar assembly according to the principles of the present invention.

The mechanical features of our invention, as shown in FIG. 1 include counterweight resonant oscillator spring 16 and print bar resonant oscillator spring 17, which are a matched pair, in both size and spring rate, and are mechanically connected together by means of spacer bars 25. Linear solenoid 14 functions as an electro-mechanical driver which, when energized, causes the pulling in of solenoid shaft 23 and the resulting mechanical pull on oscillator spring 17 and rod 18 which is mechanically connected to print bar resonant oscillator spring 17. Linear solenoid 14 is mechanically connected by means of shaft 26 to counterweight 13.

Normal Newtonian rules of physics apply, and when linear solenoid 14 is energized, causing solenoid shaft 23 to pull in, then equal and opposite forces will be applied to counterweight resonant oscillator spring 16 and print bar resonant oscillator spring 17 which, if equally matched in regard to spring rates, will pull in at an equal rate of travel in opposite directions causing print bar 12 and counterweight 13 to reciprocally oscillate at the same frequency as driven by linear solenoid 14. If the assembly of print bar 12, counterweight 13, solenoid 14 and springs 16 and 17 is suspended in space then there is but one resonant frequency of oscillation for springs 16 and 17 which would be defined by the formula:

$$F_{rn} = \frac{1}{2\pi}\sqrt{K\left(\frac{1}{M_3}+\frac{1}{M_4}\right)}$$

where $F_{rn}$ is the resonant frequency, K is the spring constant for the combination of spring 16 and 17, $M_3$ is the mass of the print bar and $M_4$ is the mass of the counterweight. This type of arrangement will eliminate the problem of multiple resonant frequencies and the corresponding need to match mass spring rate combinations in order to develop a balanced reciprocating oscillation mechanism for use with a high speed dot matrix printer.

In the preferred embodiment the counterweight and print bar assembly 10 is suspended from printer frame 11 by means of suspension springs 15. Four springs 15 are utilized in the preferred embodiment, and have identical spring constants. The spring constants for suspension springs 15 are considerably lighter than resonant oscillation springs 16 and 17. Suspension springs 15 react to the counterweight and print bar assembly 10 as if it were a single mass, and as a result the entire counterweight and print bar assembly 10, in connection with suspension springs 15, has itself a resonant frequency of oscillation relative to printer frame 11 which is determined by the formula:

$$F_{rn} = \frac{1}{2\pi}\sqrt{\frac{K}{M}}$$

where K is the spring constant for suspension springs 15 and M the total mass of the counterweight and print bar assembly 10.

Figure 7:
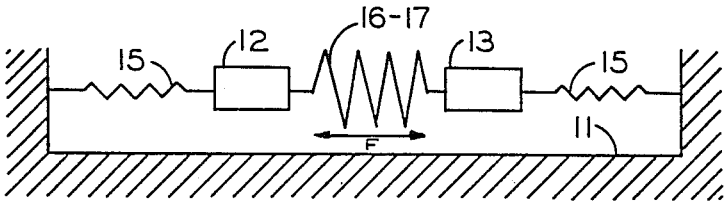
FIG. 7 is a mechanical schematic representation of the counterweight and print bar assembly shown in FIG. 1.

The counterweight and print bar assembly 10 is mechanically schematically represented in FIG. 7 where print bar 12, counterweight 13 and resonant oscillation springs 16 and 17 represent an entire oscillating assembly suspended from printer frame 11 by means of suspension springs 15.

Figure 2:
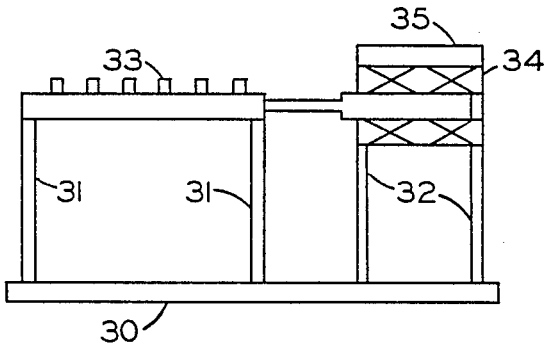
PRIOR ART FIG. 2.
FIG. 2 is a representational plan view of a prior art print bar assembly as disclosed by Khorsand, U.S. Pat. No. 4,599,007 and Miller, U.S. Pat. No. 4,637,307.
Figure 3:
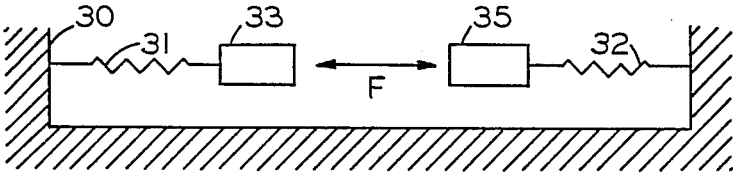
PRIOR ART FIG. 3.
FIG. 3 is a mechanical schematic view of the prior art print bar assemblies disclosed by Khorsand and Miller.

When the matched mass and spring constant assemblies, as shown in FIG. 2, and shown and described in Khorsand, U.S. Pat. No. 4,599,007 and Miller, U.S. Pat. No. 4,637,307, are mechanically schematically represented as shown in FIG. 3, the differences between the present embodiment of FIG. 7 and the prior art of FIG. 3 are readily apparent. Prior art print bar 33 is independently sprung by print bar springs 31, and counterweight 35 and solenoid 34 by counterweight springs 32. But for the mechanical connection between the two assemblies, each assembly would oscillate at an independent resonant frequency. As can be seen with the present invention, there are no independent spring mass assemblies causing an interference between multiple resonant frequencies when the two spring and mass assemblies are mechanically interconnected.

Figure 6:
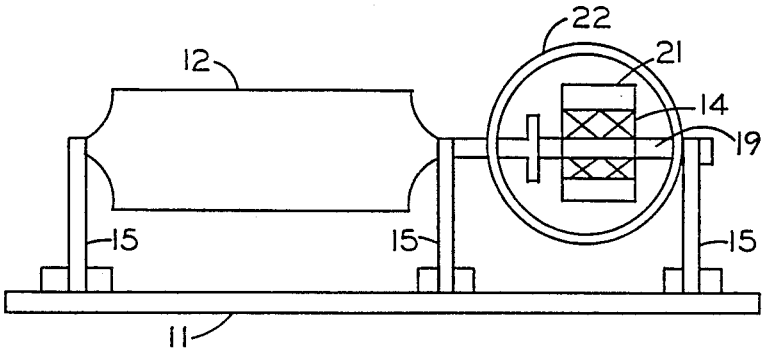
FIG. 6 is a representational plan view of a second embodiment of the counterweight and print bar assembly shown in FIG. 1 utilizing a ring spring.

FIG. 6 shows another embodiment of the present invention which utilizes a resonant oscillation ring spring 22 in lieu of a matched pair of resonant oscillation springs 16 and 17 as shown in FIG. 1. In this embodiment, a counterweight 21 and linear solenoid 14 are combined and located within resonant oscillation ring spring 22, thus eliminating a number of mechanical parts for the entire assembly and eliminating the need to match spring constants between resonant frequency oscillation springs 16 and 17. However, it functions mechanically in a manner identical to that of the embodiment described in FIG. 1, and is also mechanically schematically represented by FIG. 7.

The spring constants for resonant oscillation springs 16 and 17 are mechanically selected to provide for a desired resonant frequency of oscillation. In the preferred embodiment the resonant frequency of oscillation is 80 Hz. In a typical dot matrix line printer seven lines of dots are utilized to form the matrixes for one line of alphanumeric information. A print bar oscillating at 80 Hz prints complete lines of alphanumeric information at the rate of eleven lines printed per second.

As previously stated, the entire counterweight and print bar assembly 10 is seen by the suspension springs 15 as a single mass which results in an independent resonant frequency vibration for the assembly. Since this vibration is not induced by a driven force, it will naturally seek and eventually obtain resonant frequency vibration and the entire counterweight and print bar assembly 10 will oscillate at this resonant frequency, relative to the printer frame. Since this is not a driven oscillation, the amplitude is relatively insignificant when compared to the amplitude of reciprocal oscillation between the counterweight 13 and print bar 12. The distortions to the printed dot matrixes caused by the suspension oscillation become insignificant, and for all practical purposes, not visible or noticeable to the human eye.

Figure 4:
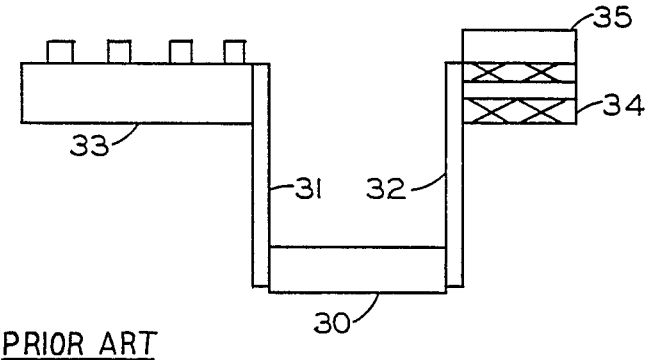
PRIOR ART FIG. 4.
FIG. 4 is a second mechanical schematic view of the prior art print bar assemblies disclosed by Khorsand and Miller.
Figure 5:
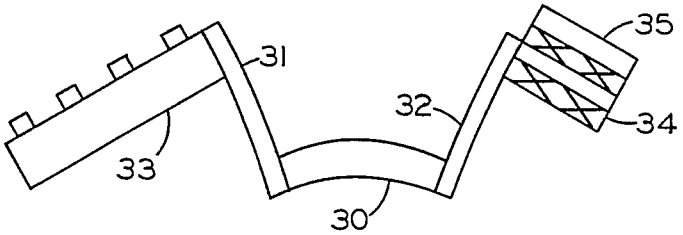
PRIOR ART FIG. 5.
FIG. 5 is a schematical representational view of the effects of the torque moments induced by reciprocal oscillation of the printer bar assembly and counterweight of the prior art print bar assemblies disclosed by Khorsand and Miller. 4,637,307.

Another advantage which results from the use of the suspended counterweight and print bar assembly 10 is that certain bending moments incurred at the suspension points for the prior art print bar assemblies of Khorsand and Miller are substantially reduced. FIG. 4 represents a mechanical schematic representation of these prior art print bar assemblies. Frames 30 of the prior art, which correspond to printer frame 11 of the present preferred embodiment, have traditionally been rather stoutly made so as to withstand the reciprocal bending moments incurred as a result of the reciprocal oscillation of independently sprung print bars and counterweights. The bending moment about the pivot point of print bar spring 31 and support frame 30, as shown in FIG. 4, is determined by the formula $M=FL$ where M is the moment, F is the force and L is the distance between the pivot point and the point of application of the force. FIG. 5 is a mechanical schematical representation of the independently sprung print bar and counterweight assembly of FIG. 4 shown in a distorted position to illustrate the effect of these bending moments upon the various components of the print bar assembly. In prior art configurations, such as those discussed herein, the force, F, in the formula above is the actual print bar assembly driving force, and, as a result, the torque moments are substantial and necessitate the use of stoutly built printer frames.

In the present invention, bending moments exist at the junction point between suspension springs 15 and printer frame 11; however, the force is not the print bar assembly driving force, but rather a randomly incurred force resulting from the reciprocal oscillation of the counterweight and print bar assembly 10 itself. This force is much smaller than the driving force and, as a result, the bending moments are substantially reduced thus allowing for use of a much lighter weight printer frame 11.

Since the frequency at which each print bar assembly will resonate is largely determined by the actual spring constants and mass weights of each particular print bar assembly, the primary function of the electrical control system is to regulate the amplitude of oscillation.

Figure 8:
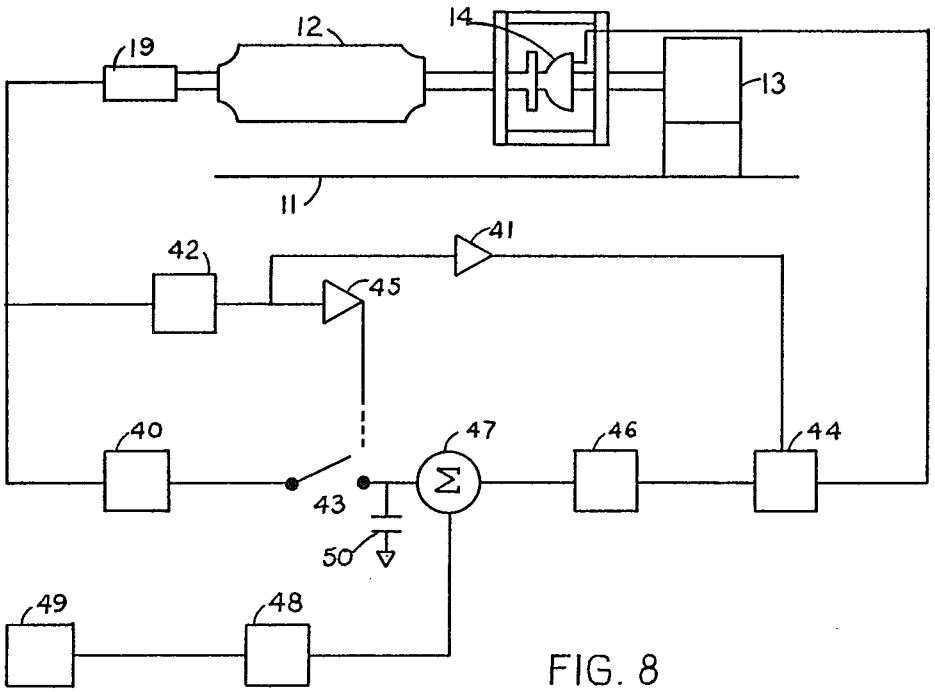
FIG. 8 is an electrical schematic representation of the electrical control system for the counterweight and print bar assembly shown in FIG. 1.
Figure 9:
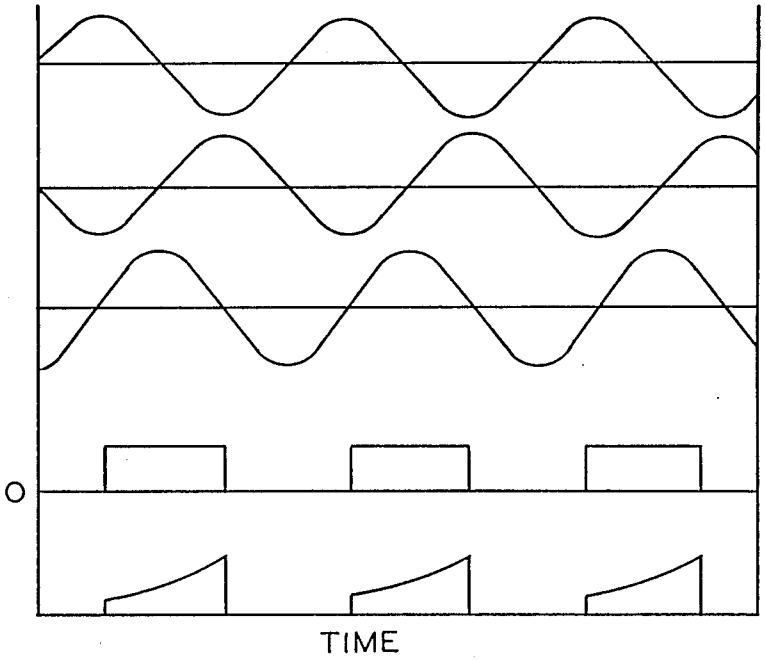
FIG. 9 is a diagram showing various electrical signals and forces induced by the electrical control system shown in FIG. 8.

Resonant frequency oscillation is sinusoidal, and the output from the velocity transducer 19 as shown in FIGS. 1 and 8 will be at its peak as the print bar 12 passes through the center point of the reciprocal oscillation cycle as shown in FIG. 9. Also, since frequency is constant, the velocity transducer peak signal is proportional to the amplitude of oscillation.

The signal from velocity transducer 19 is sent through a full wave rectifier 40. It is also directed to an integrator 42 wherein it is converted to a signal representative of the location of print bar 12 as opposed to its velocity. In this respect, when the output signal from integrator 42 passes through zero volts it is representative of the print bar passing through the center point of its reciprocal oscillation. Hence the output signal from integrator 42 represents, when it is zero volts, the point in time when print bar 12 is at its maximum velocity.

The output signal from integrator 42 is received by signal comparator 45 which closes electronic switch 43 whenever the output signal from integrator 42 is near zero volts.

When electronic switch 43 closes, the output signal from rectifier 40 is at its maximum and is proportional to the speed of print bar 12 as it passes through the center point of oscillation, thereby being proportional to the amplitude of oscillation. The peak output signal level from rectifier 40 is thus converted into a DC signal proportional to the amplitude of reciprocal oscillation of print bar 12.

Electronic switch 43 is connected to capacitor 50 which receives and holds the peak amplitude from the output of rectifier 40. The peak amplitude signal is compared to a reference voltage output from the digital-to-analog converter (DAC) 48. The DAC 48 provides a steady DC reference voltage to error comparator 47, in response to a signal from microprocessor 49.

Error comparator 47 is a summing circuit which outputs either a positive or negative voltage representing the difference between the reference signal from DAC 48 and the output signal from electronic switch 43. This error signal is amplified by loop amplifier 46 and is the input signal for output amplifier 44.

As with any solenoid, when the windings of drive solenoid 14 are energized, the core is drawn into the central area of the winding. Thus, energy is added to the reciprocally oscillating mechanical system when and if drive solenoid 14 is energized as the print bar 12 and counterweight 13 are moving toward each other. In this particular embodiment, the need for addition of energy to the system to increase the amplitude of reciprocal oscillation is represented by a positive voltage signal emanating from error comparator 47 and being amplified by loop amplifier 46. Thus output amplifier 44 needs to energize the windings of drive solenoid 14 only on the inward oscillation portion of the reciprocal oscillation cycle of print bar 12.

Hence the output signal from integrator 42, which represents the position of print bar 12, is used to drive direction comparator 41 to provide a directional signal to output amplifier 44 in order to indicate when the signal from output amplifier 44 should be used to drive solenoid 14.

Conversely, if the error signal output from error comparator 47 is a negative voltage, it represents a condition wherein the amplitude of reciprocal oscillation for print bar 12 is too great, and removal of energy from the system is required. Removal of energy is accomplished by energizing the windings of drive solenoid 14 during the portion of the reciprocal oscillation cycle when print bar 12 and counter weight 13 are moving away from each other. Output amplifier 44, receiving a negative voltage signal from loop amplifier 46, will only energize the winding for drive solenoid 14, during the phase of the reciprocal oscillation cycle when the print bar and counter weight are moving away from each other as detected by direction comparative 41. Thus the absolute value of the voltage signal from loop amplifier 46 controls the level of the current with which the output amplifier 44 drives the drive solenoid.

FIG. 9 is a chart which shows the relative values and positions of the drive solenoid position, print bar position, print bar velocity, drive solenoid current and drive solenoid force. As can be seen, the maximum force from the drive solenoid is generated at the point when the print bar 12 and counterweight 13 are at their closest point.

While there is shown and described the present preferred embodiment of the invention, it is to be distinctly understood that the invention is not limited thereto, but may be variously embodied to practice within the scope of the following claims.

We claim:

1. An apparatus which comprises:

a frame;

a print bar assembly mass;

first mounting means for mounting the print bar assembly mass on the frame for reciprocal oscillatory motion;

a counterweight mass;

second mounting means for mounting the counterweight mass on the frame for reciprocal oscillatory motion;

a closed perimeter ring spring operatively connecting the print bar assembly mass to the counterweight mass for reciprocal oscillation of the masses at a signal resonant frequency; and electrically operable means for inducing reciprocal oscillation of the masses at a single resonant frequency.

2. The apparatus of claim 1 wherein the means for inducing reciprocal oscillation of the masses further comprises a solenoid having an outer winding assembly and a core slideably mounted therein, disposed within the circumference of the closed perimeter ring spring for imparting reciprocal oscillation to opposite sides of the closed perimeter ring spring.

3. An apparatus which comprises:

a frame;

a print bar assembly mass;

first mounting means for mounting the print bar assembly mass on the frame for oscillatory motion;

a counterweight mass;

second mounting means for mounting the counterweight mass on the frame for oscillatory motion;

a closed perimeter ring spring operatively connected to the print bar assembly mass and to the counterweight mass for reciprocal oscillation of the masses at a single resonant frequency;

a solenoid having an outer winding assembly and a core slidably mounted therein disposed within the circumference of the closed perimeter ring spring for imparting reciprocal oscillation to opposite sides of the closed perimeter ring spring; and means for controlling the amplitude of the reciprocal oscillation.

* * * * *